US009523197B2

(12) United States Patent
Sessler et al.

(10) Patent No.: US 9,523,197 B2
(45) Date of Patent: Dec. 20, 2016

(54) SOUND DAMPENING WALL

(71) Applicants: Jon Sessler, Sumner, WA (US); Michael Sessler, Sumner, WA (US)

(72) Inventors: Jon Sessler, Sumner, WA (US); Michael Sessler, Sumner, WA (US)

( * ) Notice: Subject to any disclaimer, the term of this patent is extended or adjusted under 35 U.S.C. 154(b) by 0 days.

(21) Appl. No.: 14/709,037

(22) Filed: May 11, 2015

(65) Prior Publication Data

US 2015/0361659 A1 Dec. 17, 2015

Related U.S. Application Data

(60) Provisional application No. 62/010,898, filed on Jun. 11, 2014.

(51) Int. Cl.

| | |
|---|---|
| ***E04B 2/58*** | (2006.01) |
| ***E04B 1/84*** | (2006.01) |
| ***E04B 2/74*** | (2006.01) |
| *E04B 2/78* | (2006.01) |
| *E04C 3/29* | (2006.01) |

(52) U.S. Cl.

CPC ..... *E04B 2/7412* (2013.01); *E04B 2/7457* (2013.01); *E04B 1/8409* (2013.01); *E04B 2/7409* (2013.01); *E04B 2/789* (2013.01); *E04C 3/29* (2013.01)

(58) Field of Classification Search

CPC ..... E04B 2/58; E04B 1/24; E04B 1/84
USPC ..... 52/483.1
See application file for complete search history.

(56) References Cited

U.S. PATENT DOCUMENTS

| | | | | | |
|---|---|---|---|---|---|
| 1,951,346 | A * | 3/1934 | Collins | E04B 2/7854 | 52/241 |
| 3,949,529 | A * | 4/1976 | Porter | E04B 1/7612 | 52/281 |
| 4,107,893 | A * | 8/1978 | Rensch | E04B 1/24 | 52/775 |
| 6,125,608 | A * | 10/2000 | Charlson | E04B 1/7604 | 52/404.1 |
| 8,516,778 | B1 * | 8/2013 | Wilkens | E04C 3/292 | 52/309.13 |
| 8,720,141 | B2 * | 5/2014 | Shembekar | E04F 13/0801 | 52/309.8 |
| 8,826,616 | B1 * | 9/2014 | Gosselin | E06B 3/9616 | 52/204.5 |
| 2007/0227095 | A1 * | 10/2007 | Hubbe | E04B 2/707 | 52/653.1 |
| 2008/0245603 | A1 * | 10/2008 | Tinianov | E04B 1/86 | 181/207 |
| 2011/0239573 | A1 * | 10/2011 | Lockhart | E04B 2/7412 | 52/404.1 |
| 2013/0025966 | A1 * | 1/2013 | Nam | E04B 2/7409 | 181/290 |

* cited by examiner

*Primary Examiner* — Joshua J Michener
*Assistant Examiner* — Keith Minter
(74) *Attorney, Agent, or Firm* — Seed IP Law Group LLP

(57) ABSTRACT

An acoustic dampening dual-stud construction member is disclosed herein. The dual-stud construction member is composed of two single studs adhered to each other with an acoustic dampening material and spaced a fixed distance apart from each other as a single unitary member which may be used in building construction. Walls having a high sound transmission coefficient may be quickly and easily assembled using the unitary member composed of two studs.

20 Claims, 8 Drawing Sheets

SOUND DAMPENING WALL

BACKGROUND

Technical Field

This invention relates to a wall which provides dampening of sound and, in particular, a quick and economical method of constructing a double-stud wall providing significantly improved sound dampening characteristics, while being low in cost.

Description of the Related Art

At present, many environments desire to have effective sound dampening between adjacent rooms. In many commercial construction locations, such as hospitals, office buildings, and the like, it is desired to have low sound transmission between adjacent rooms. Presently, one method by which this is accomplished is to place thick layers of acoustic insulation in the wall between the rooms and to place studs on either side of the wall. This has the disadvantage of being expensive and time-consuming to construct. Other techniques include placing multiple layers of drywall on the studs of the wall, or specialty drywall products which have high acoustic dampening properties. The disadvantage of this approach is that it is expensive because of the cost of extra materials and labor to install said materials or the high cost of sound dampening specialty Drywall and, in addition, is also time-consuming, which raises labor cost.

One measure of the sound dampening characteristics of a wall is called the sound transmission coefficient (STC). The STC of a particular wall provides an indication of the attenuation which the wall provides for acoustic waves and, thus, a good indication of the sound dampening that it provides between adjacent rooms. A standard sheet of drywall, which is a low gypsum board, may have an STC of approximately 26. Thicker drywall may have STCs in the range of 28 and 29. Two drywall panels placed abutting each other, if each is a standard gypsum board, will have an STC of 34. Generally, an STC in the range of 35 or lower indicates that a significant amount of sound will pass from one room to another and the wall provides little attenuation. In order to obtain attenuation in the range of 55-60, which is often desired, it is currently the practice to create two walls, each of which has a set of studs to support the drywall, and then place one or more layers of sound-attenuation material, such as an acoustic dampening insulation or other material, between them. While such a structure is sufficient to obtain an STC in the range of 55 or higher, it is expensive, time-consuming to construct, and also takes some skill to properly assemble.

Past attempts to increase the STC of wall assemblies have focused on specialty products which, in many instances, are prohibitively expensive. Other techniques have been to add significant layers of conventional materials that increase the mass, which, while it will increase the STC rating, adds significant cost as well as additional time, and takes up more space. Other attempts have been to use multiple phases in the wall assembly in order to add layers of conventional construction material at the same surface to achieve a higher STC rating. However, this increases the time in which construction can be completed and also increases the cost. The schedule is affected negatively if multiple phases are used for the construction due to more materials having to be installed at the site, which, in turn, requires a longer duration for the phase of work, which impacts the construction schedule along with the additional time. Another downside of using multiple layers of materials or multiple phases is the reduction in floor area that happens if additional layers of materials are added to the wall assembly.

BRIEF SUMMARY

According to principles of the embodiments as disclosed herein, a sound dampening stud pair is provided which allows for sound separation through acoustically isolated framing members. Framing studs are provided which are preassembled as a pair of studs having a acoustic dampening material therebetween. The acoustic dampening dual-stud construction allows for structural reinforcement of the wall, maintaining sound transmission separation. Good sound isolation is provided between adjacent structural rooms and different building elements. Further, because the dual stud comes as a single unitary completed product, this provides the ability to build an acoustically separated wall in fewer phases and much more quickly. In addition, the prefabricated acoustic isolation dual stud greatly increases the useable square footage of the building while providing an equal or, in many instances, a better STC rating than was possible with conventional materials.

Further, providing the dual studs as completed products significantly decreases the overall construction time and schedule by eliminating steps during the construction process. The acoustically isolated studs can be prefabricated in large numbers at an assembly factory and then delivered as a completed product to the construction site for rapid construction of a single wall having dual studs with a high STC rating that dampens the sound transmitted between rooms.

DETAILED DESCRIPTION

Figure 1A:
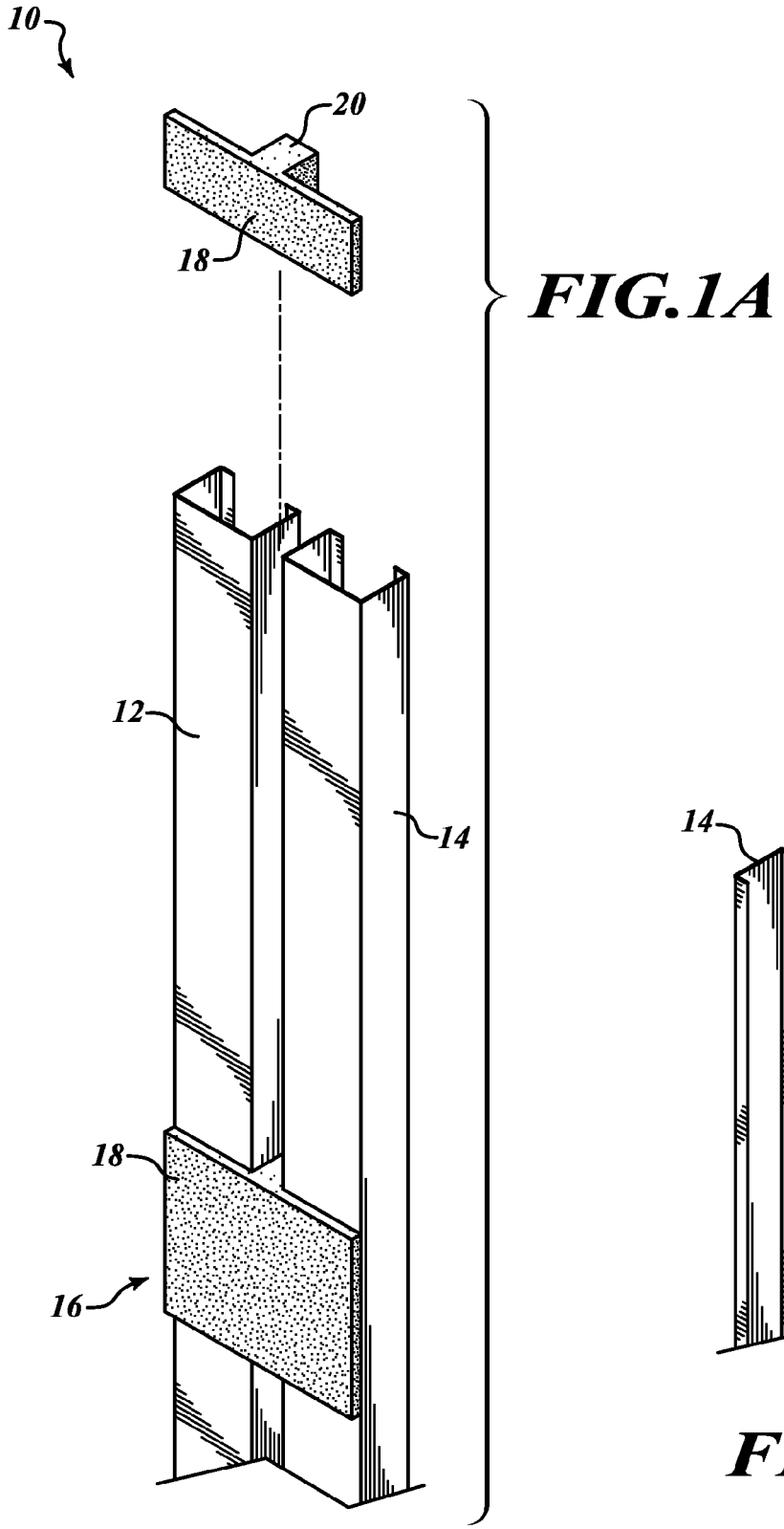
FIGS. 1A and 1B are isometric views of the dual-stud assembly.
Figure 1B:
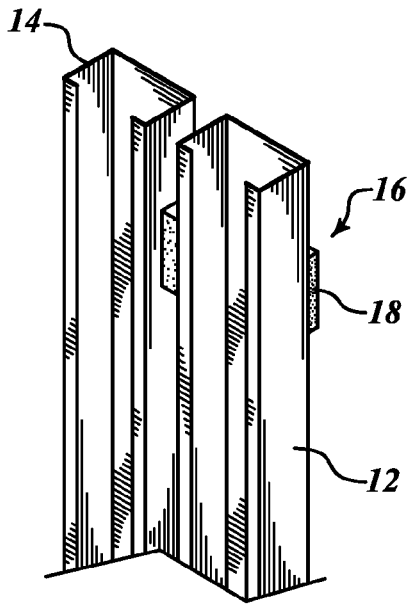

FIGS. 1A and 1B illustrate one example of a dual-stud assembly for building a sound dampening structure in a wall. In particular, FIG. 1A shows a sound dampening structure 10 having a first stud 12 and a second stud 14. The studs will generally be of the type that are sheet metal studs which are in the form of a channel having one side open and the metal bent at an angle at the open side. Such metal studs are well known in the building industry and have been used for many years in the construction of commercial buildings. The studs will generally be parallel to each other. An acoustic dampening member 16 is adhered to the studs at a desired location. The acoustic dampening member 16 includes a flat portion 18 and an isolation member 20 which holds the studs apart from each other while also providing sound dampening properties between the metal studs.

FIG. 1B shows the same metal stud of FIG. 1A but turned 180° so that the open channels can more easily be seen and the acoustic dampening member 16 is adhered to the studs.

The acoustic dampening member 16 can be adhered to the metal studs by any acceptable method. This may include an adhesive material such as a glue, or other material such as tape, a fastener, or any other acceptable technique. The acoustic dampening member 16 is preferably made of any acceptable material that has low acoustic transmission and sufficient structural strength in order to adhere to the metal studs 12, 14 while holding them isolated from each other with little to no compression. There are a number of types of material which would be acceptable for the acoustic dampening member 16. This may include various types of rigid materials, rubber, plastic, PVC, foam, sponges, gels, or the like. One material which has been found to be acceptable is a type of material known as IV3, which is a foam cell polymer material. In the industry, it is sometimes sold under the name Ensolite IV3 and is available from many different manufacturers. This is a closed-cell stiff foam material that is made of a polymer. It can, in some instances, include neoprene, PVC, or a type of sponge rubber.

Figure 2A:
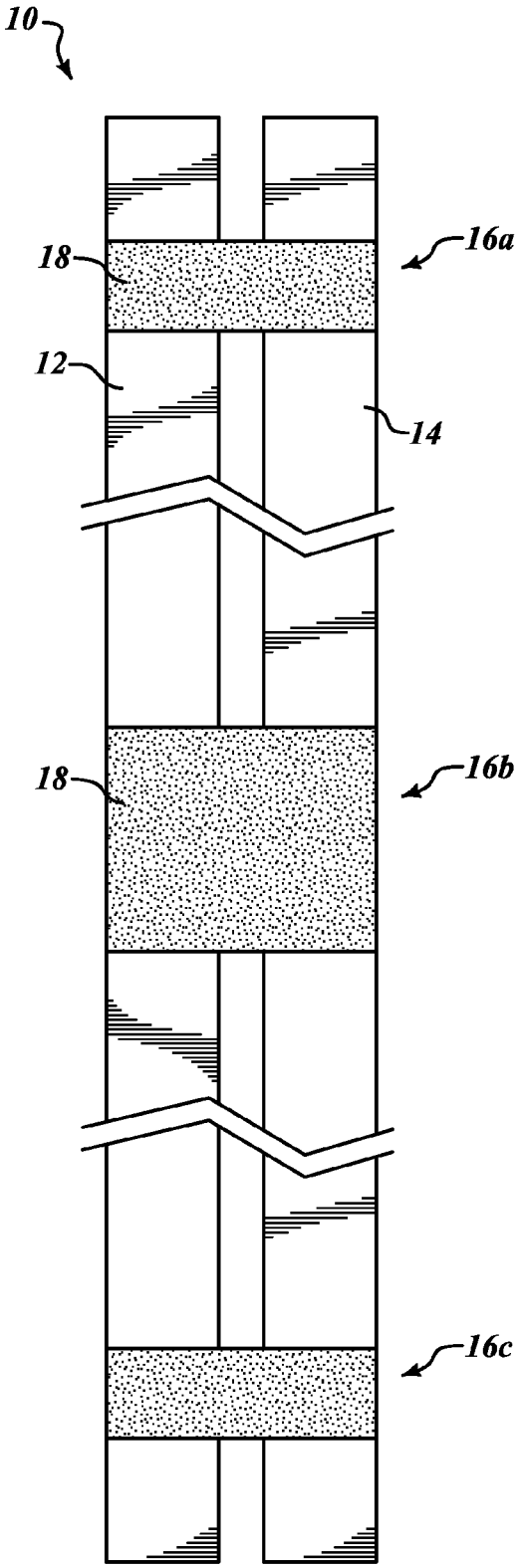
FIGS. 2A-2F show various embodiments of the dual-stud assembly.
Figure 2B:
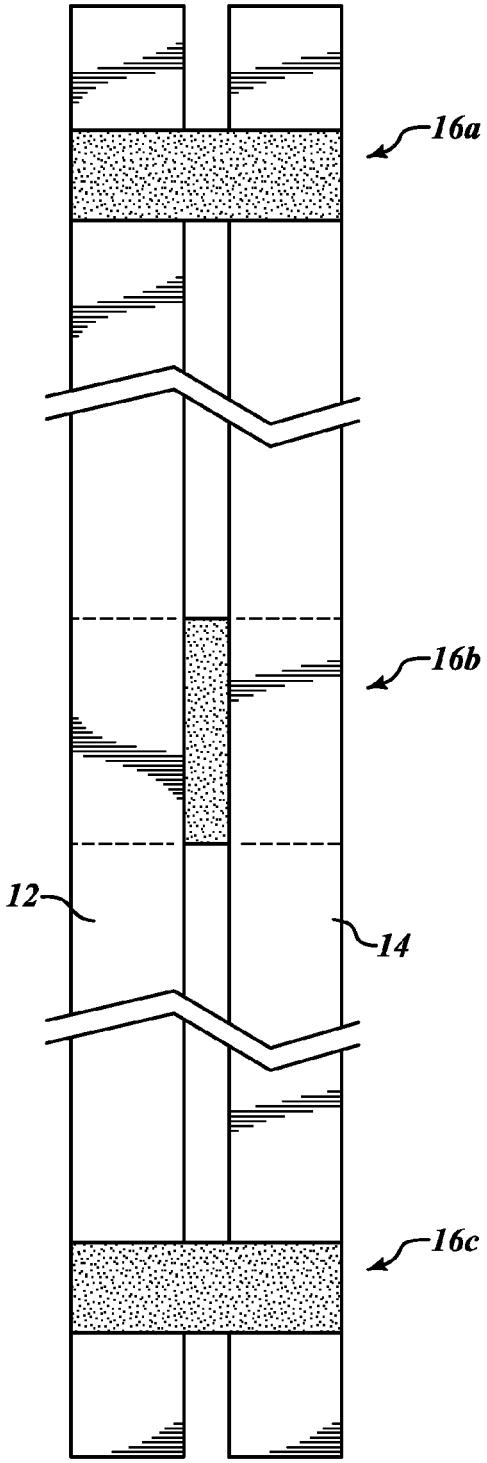

FIGS. 2A and 2B show one example of a fully assembled dual stud 10 constructed according to the principles as disclosed herein. In one embodiment, the dual stud 10 shown in FIGS. 2A and 2B is a standard construction length stud having a length of 8 feet, 10 feet, 12 feet, or other length common in the industry. The fully assembled dual stud 10 actually includes two studs 12, 14 which have been coupled to each other using the acoustic dampening member 16 to form a unitary structure.

In the embodiment shown in FIG. 2A, three acoustic dampening members 16*a*, 16*b*, 16*c* are provided for the single unitary stud 10. In this instance, each acoustic dampening member 16*a*, 16*b*, 16*c* has a flat portion 18 which is adhered to the broad, flat face of each stud 12 and 14. This provides a broad area for adhesion and a solid anchor for the isolation member 20 to adhere between the two studs 12, 14 in order to provide significant construction strength and stability to the dual-stud assembly 10.

FIG. 2B illustrates an alternative embodiment in which one of the acoustic dampening members 16, in this case the acoustic dampening member 16*b*, is placed facing the opposite direction, namely having the flat side against the open channel of the studs 12, 14.

Figure 2C:
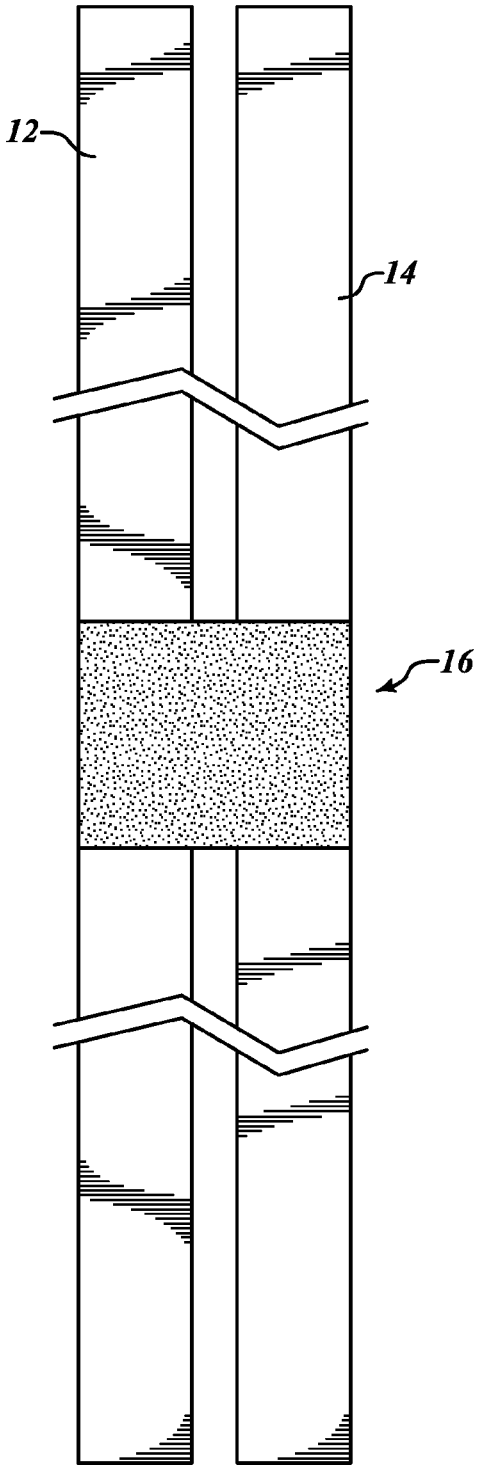

FIG. 2C is one embodiment in which only a single acoustic dampening member 16 is used and the studs 12, 14 are held isolated from each other by the single member 16.

Figure 2D:
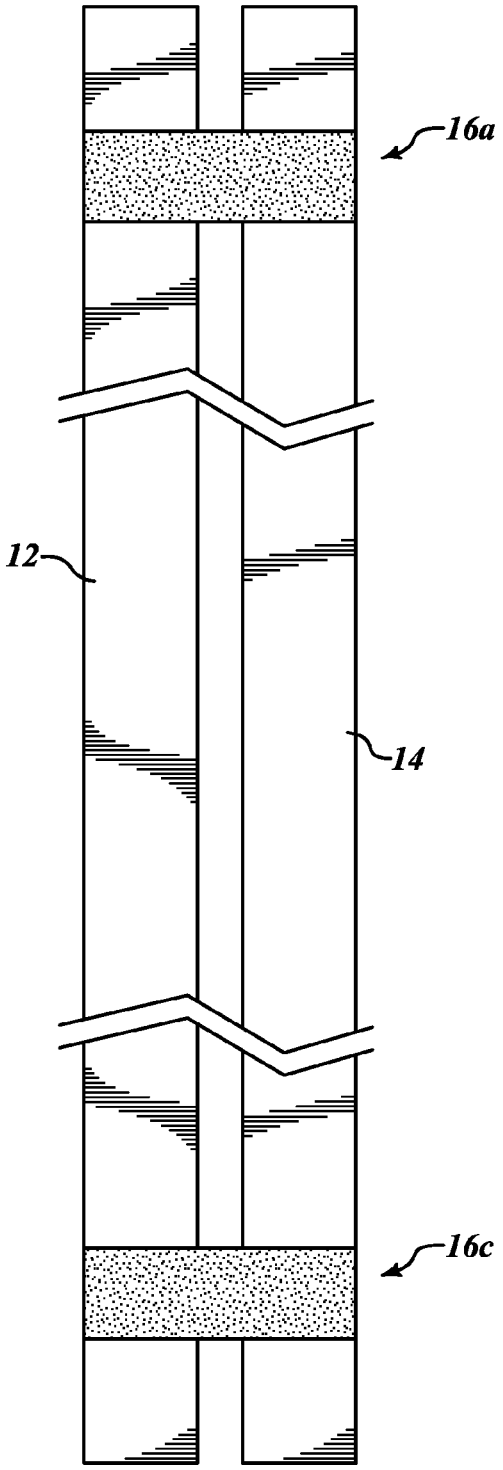

FIG. 2D illustrates the embodiment in which two acoustic-isolating members 16*a*, 16*c* are coupled to the two studs 12, 14 and connect them to each other. In most construction projects, the studs 12, 14 will be connected to the floor at a floor region and to the ceiling at a ceiling region by some acceptable technique, such as sheet metal screws, a rail fixing system, or some other acceptable technique. Accordingly, in many embodiments it is acceptable to use only a single isolating member 16 in the central region of the stud, such as 4 feet from each end, since the studs 12, 14 will be fixed at each of their respective ends by a floor and a ceiling, as shown in FIG. 2C. In other designs, it is preferred to have two members 16*a*, 16*c*, as shown in FIG. 2D, which maintain a fixed distance between both ends of the studs 12, 14 before it is fixed in place in the wall.

Figure 2E:
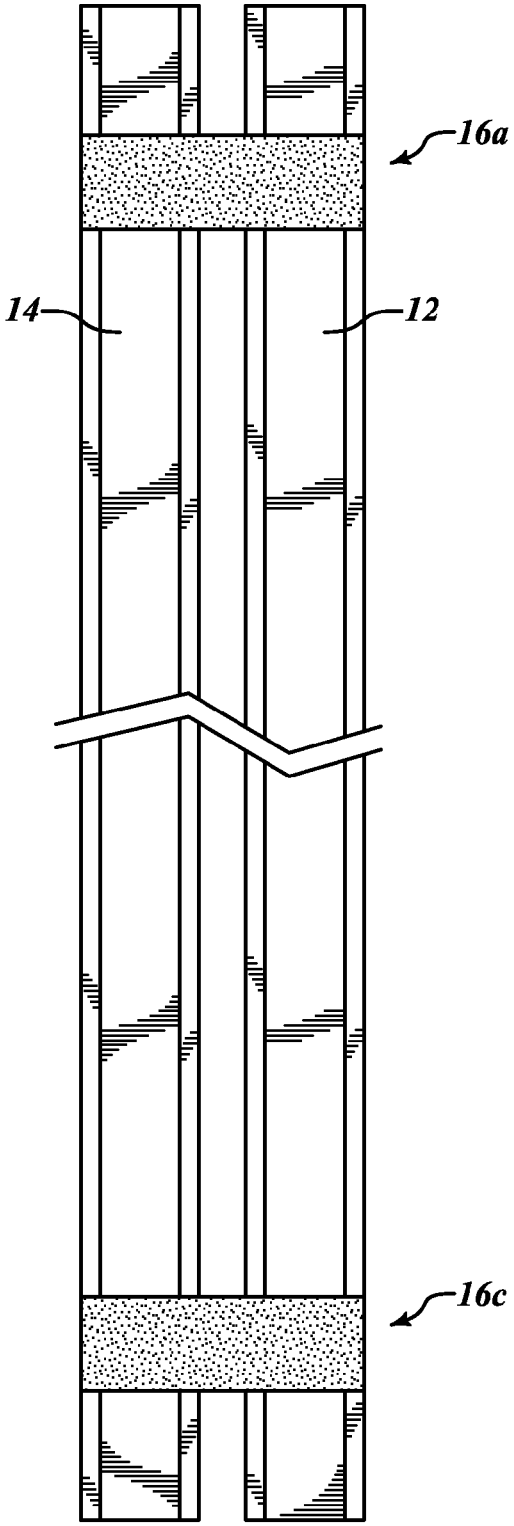

FIG. 2E shows a further alternative embodiment in which the acoustic dampening members 16*a*, 16*c* are placed on the open channel side of the studs 12, 14.

Figure 2F:
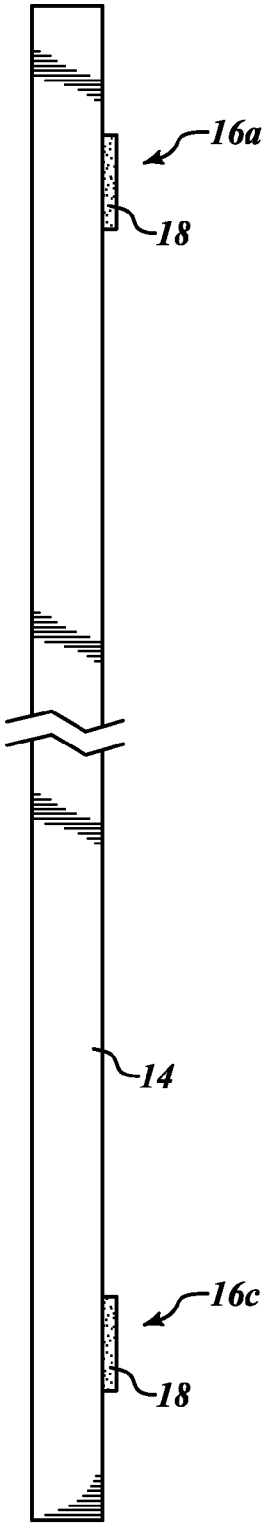

FIG. 2F shows a side view of the embodiment of FIG. 2E in which the flat portion 18 can be seen against one side of the metal stud 14.

Figure 3A:
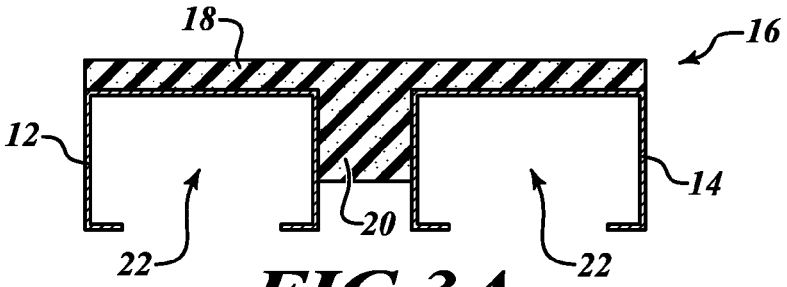
FIGS. 3A-3H are cross-section views of various embodiments of the dual-stud assembly.

FIGS. 3A-3G illustrate alternative potential designs for the acoustic dampening member 16 to be adhered to the two studs 12, 14. As can be seen in FIG. 3A, the acoustic dampening member 16 has a flat portion 18 with an isolation member 20 positioned between the two studs 12, 14. Each stud has an open channel 22 that remains open in this embodiment. The width and shape of the isolation member 20 is selected to provide sufficient distance that the studs 12, 14 are acoustically isolated from each other and also of sufficient strength to hold them in a rigid position so that they will not break during construction or during shipping.

In one preferred embodiment, the sound isolating member 20 has a thickness of approximately an inch. In other embodiments, the distance may be different, such as one-half inch or five-eighths inch, as may be desired depending on the thickness of the overall wall to be assembled. The thickness of the flat portion 18 may be in the range of one-half inch or, in some embodiments, one-quarter inch, which should be of sufficient thickness to have the strength to rigidly adhere to each of the metal studs 12, 14 and not break, rip, or tear during shipping to a construction site or when being assembled for construction into a wall.

If different types of material are used, then the acoustic dampening member 16 may have somewhat different dimensions. For example, if a very dense rubber is used, then the flat sheet portion may only be in the range of one-eighth inch and the acoustic isolation member one-half inch or less. On the other hand, if a foam material having large cells is used, which may have more compression, then it may be desired to have somewhat thicker material.

Figure 3B:
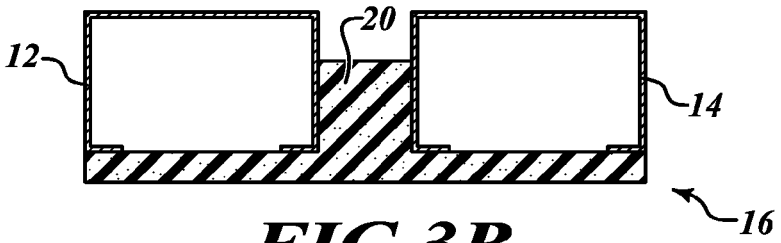

FIG. 3B shows the embodiment in which the acoustic dampening member 16 is connected to the open channel side of the studs 12, 14. The channel 22 is therefore closed at this location and the stud has effectively four walls.

Figure 3C:
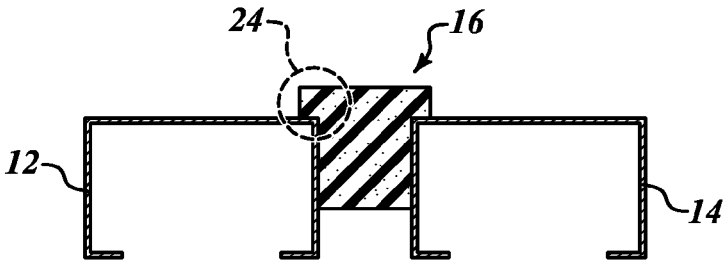

FIG. 3C shows the embodiment in which the acoustic dampening member 16 is adhered to the studs 12, 14 and has only a small flat portion 18 with a shoulder 24 that extends a short distance across the back, flat, planar surfaces of the respective studs. Such a smaller member 16 would be lower in cost and easy to manufacture since the acoustic dampening member 16 can be quickly placed on the two studs and self-aligned because it has a shoulder region, which is circled on FIG. 3C.

Figure 3D:
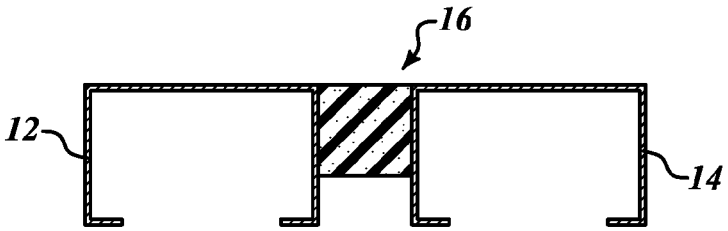

A yet further alternative embodiment is shown in FIG. 3D in which the acoustic dampening member 16 is a rectangular block. Such an acoustic dampening member 16 is much easier to manufacture and lower in cost. The side walls of the acoustic dampening member 16 are adhered to the facing side walls of the studs 12, 14 and, with use of a strong adhesive, the studs are rigidly coupled to each other with sufficient strength to be a unitary stud until they can be assembled into a final wall, at which time they would be fixed at the top end and bottom end with the appropriate fasteners.

The embodiments of the type shown in FIGS. 3C and 3D use much less sound dampening material and, thus, are lower in cost to manufacture.

Figure 3E:
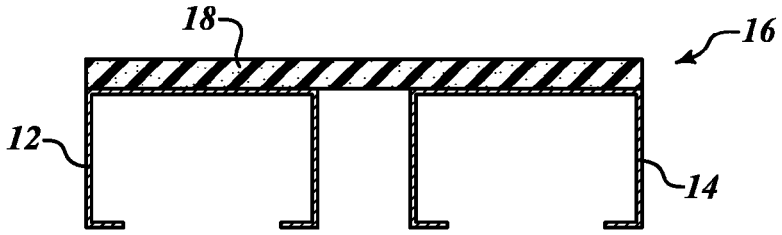

FIG. 3E shows an embodiment in which the acoustic dampening member 16 is a rectangular flat sheet which contains only the flat portion 18. There is no additional acoustic dampening member 16 that is affixed between the two studs 12, 14. Generally, a vacuum or open air has good acoustic isolation properties as compared to a metal wall. Thus, in the embodiment of FIG. 3E, the flat portion 18 prevents vibration from traveling from one stud 14 to the other stud 12 because the acoustic dampening member coupling them together provides high attenuation of sound.

The two studs 12, 14 are isolated from each other by an air space, which provides some sound insulation as well.

Figure 3F:
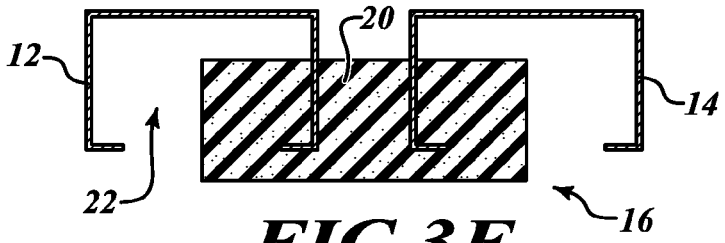

The embodiment of FIG. 3F illustrates that the acoustic dampening member 16 is affixed inside of the channel of the studs 12, 14. In particular, channel 22 of each of the studs 12, 14 has a portion of the acoustic dampening member 16 positioned therein and the material is rigidly affixed to one leg of the studs on the inside and the outside and has an acoustic dampening member 20 in between.

Figure 3G:
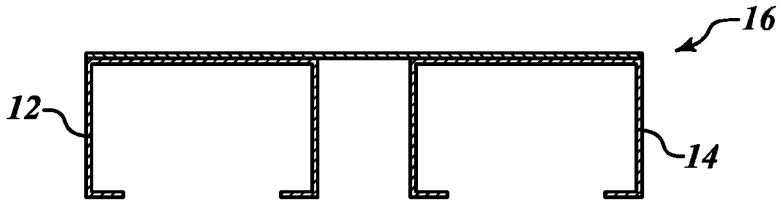

FIG. 3G shows a further alternative embodiment in which the acoustic damping member is composed of a metal, preferably steel. When the acoustic damping member 16 is made of a metal, such as steel, it is a thin, rigid piece, less than 3 mm (under ⅛"') in thickness and in some embodiments it is about 1 mm or less, for example, 0.5 mm or 0.457 mm, which is 18 mils. While steel is generally considered a good conductor of sound, if only a thin metal strip that is in the range of 0.5 mm thick connects the first stud to the second stud, this will effectively attenuate sound transmission between the two metal studs 12 and 14. In one design, a thin metal sheet that is about 0.5 mm thick and having a width of about 3-4 cm (1.5") is coupled by two sheet metal screws to the first metal stud 12 and the second metal stud 14. This sheet metal strip is the acoustic damping member 16. The sheet metal screws may, in one embodiment, have a rubber gasket around the shaft to further dampen the sound. Since the sheet metal isolates the two studs from each other, is quite thin and does not have much mass, an acoustic wave in one stud will not travel well through the thin metal sheet and will be effectively attenuated. The dual studs can be connected with the thin metal sheet member according to the various embodiments shown in FIGS. 2A-2F.

Figure 3H:
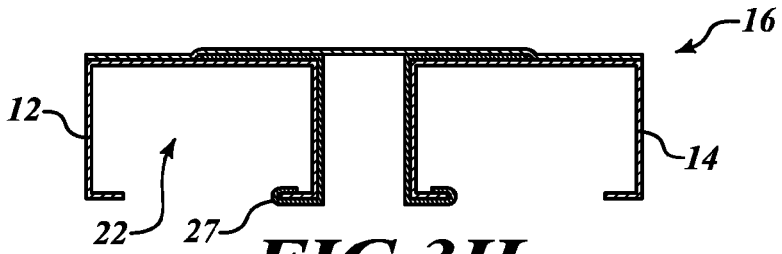

FIG. 3H shows a further alternative embodiment to that shown in FIG. 3G in which the acoustic damping member is composed of a metal, preferably steel, and a bracing member 27, also made of sheet metal, is connected to each stud 12 and 14. When the acoustic damping member 16 is made of a very thin metal strip that is less than 0.5 mm, it is helpful to add some further bracing members. In the alternative embodiment of FIG. 3H, two bracing members 27 are added, each being about 18 mil, which is in the range of less than 0.5 mm thick. The bracing members 27 provide additional support and further sound dampening.

As has been shown, the acoustic dampening member 16 can take various forms and be positioned at various locations in order to affix the studs 12, 14 to each other to achieve a unitary sound dampening dual-stud member that can be used in construction.

According to a preferred embodiment, the dual-stud sound-isolation structure 10 is assembled at a construction factory in a mass production assembly operation. The assembly plant for the sound-isolation studs 10 does not need to be near the construction site. The sound-isolation dual-stud members 10 are assembled as complete units at the remote manufacturing facility in the desired lengths, such as 8 feet, 10 feet, 12 feet, and the like. Then they are shipped to the construction location during the building phase and used as the wall studs to form walls between adjacent rooms. The workmen, when building the wall, will take the single unitary dual stud 10, that is composed of the two studs 12, 14, and the acoustic dampening member 16, since it is provided as a single unit, into the desired location in order to build the wall. The worker is, thus, able to place two studs at the same time in a single construction step. In addition, the two studs 12, 14 are acoustically isolated from each other and, therefore, provide a very high STC.

Figure 4:
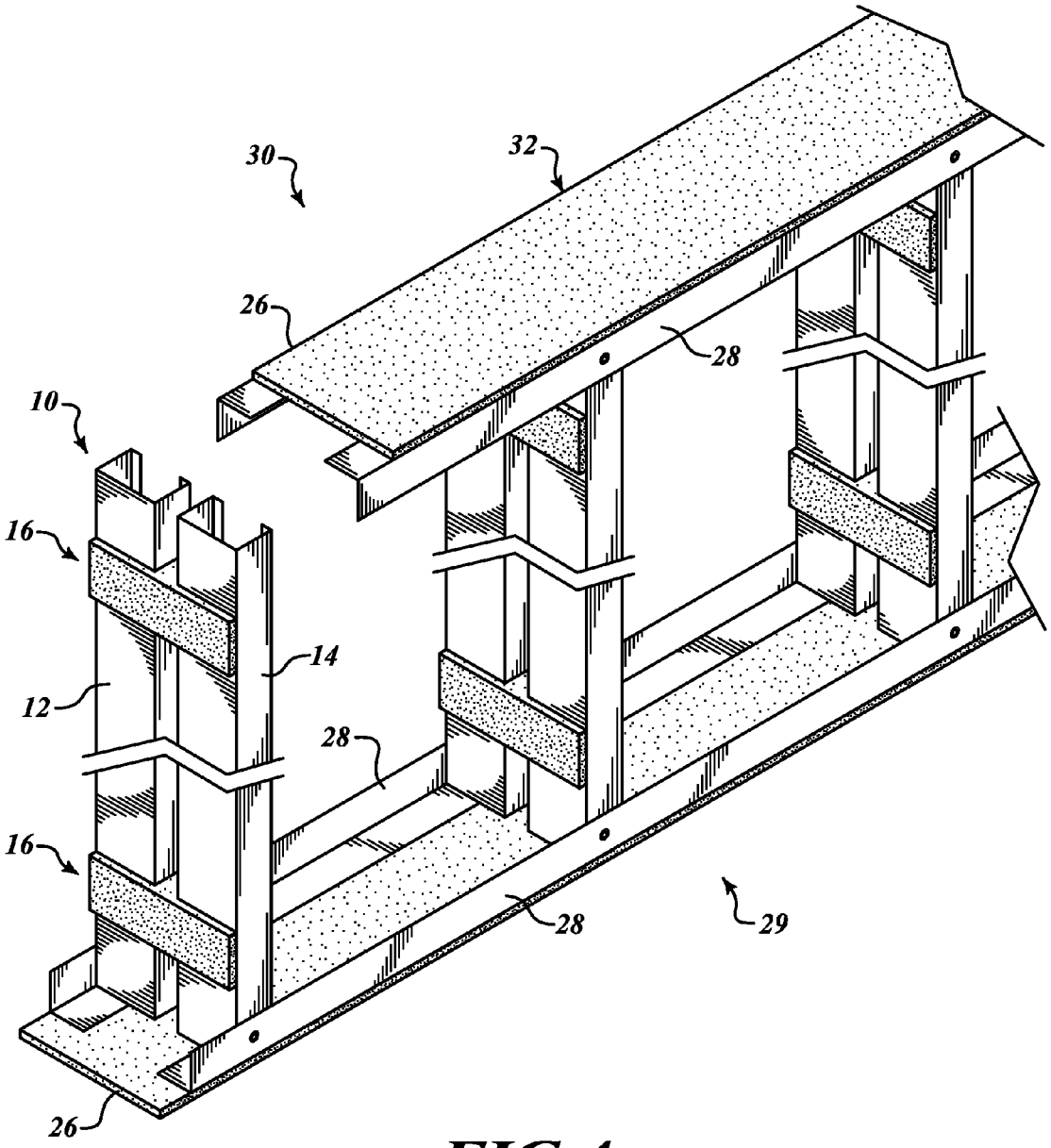
FIG. 4 is an isometric view of a partially completed wall.

FIG. 4 illustrates a construction of a wall of a type that would be done in a commercial building between adjacent rooms. During the assembly of the wall, an acoustic dampening layer 26 is positioned on the floor at the floor region in a location in which it is desired to construct the wall. Further, an acoustic dampening layer 26 is also positioned on the ceiling, directly above the location in which the wall is to be constructed at the ceiling region. Simple angle members 28, such as sheet metal bent at a 90° angle, are then placed on top of the sound-isolating material separated by a distance that accommodates the width of the studs 12, 14 when assembled in the single unitary dual-stud 10. The final floor assembly 29 including the angle member 28 and acoustic dampening layer 26, combined, is then fixed to the floor by any acceptable technique. If it is a concrete floor, the floor assembly 29 may be affixed by fasteners which extend through the angle members 28 and the acoustic dampening layer 26, such as concrete nails. Alternatively, the floor assembly 29 may be adhered to the bottom by different types of glue, adhesive, or any acceptable technique.

There are a number of types of material which would be acceptable for the acoustic dampening layer 26. This may include various types of rigid materials, rubber, plastic, PVC, foam, sponges, gels, or the like. One material which has been found to be acceptable is a type of material known as IV3, which is a foam cell polymer material.

The ceiling assembly 32 is also adhered to the ceiling by any acceptable technique (that also includes angled members 28 and the acoustic dampening layer 26). The preassembled sound-isolating dual-stud 10 is thereafter placed into the channel which is formed by the two angled members 28 and attached by any acceptable technique, such as sheet metal fastening screws, an adhesive material, or the like. In the example shown in FIG. 4, a wall of standard height, such as 8 feet, is constructed. The example shown in FIG. 4 is in the middle of the construction phase so that the components can be easily seen. After the structural members of the wall have been assembled, then the appropriate drywall material will be added, such as a desired drywall, gypsum board, or the like. Since the two studs 12, 14 are acoustically separated from each other, standard drywall that is low in cost may be used, rather than requiring the use of expensive acoustic dampening material. In addition, in most embodiments it is preferred to leave open space between the adjacent dual-stud members 10, as shown in FIG. 4. If desired, thermal insulation, sound insulation, or a material which provides both thermal insulation and sound insulation may be placed in the wall structure 30 as it is being constructed, which can provide further thermal and acoustic isolation between the two rooms.

Figure 5:
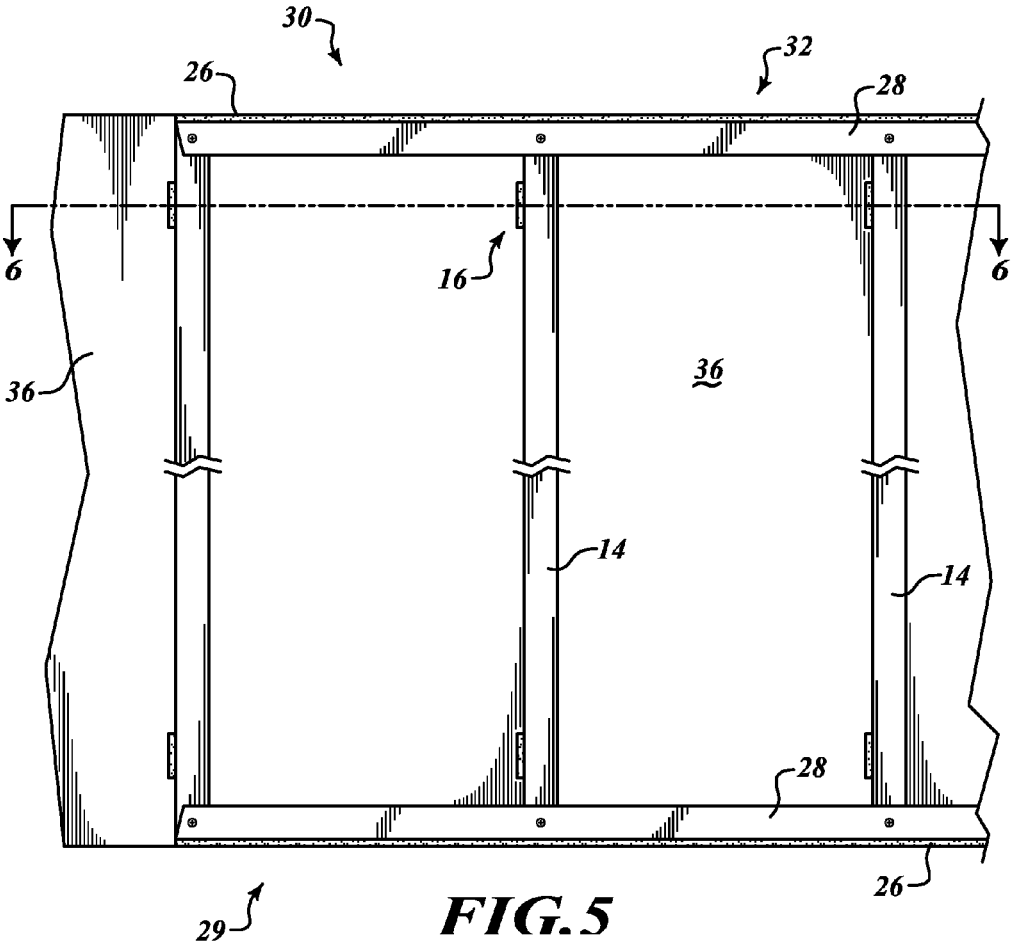
FIG. 5 is a side elevation view of the structure shown in FIG. 4 with one layer of drywall added.

FIG. 5 is a side elevation view of the structure shown in FIG. 4 with drywall 36 added. The studs 14 can be seen attached to the acoustic dampening layer 26, the angle members 28 of the floor assembly 29, and a similar construction coupled at the ceiling assembly 32. The acoustic dampening member 16 is affixed to the studs 12, 14 in the manner which has been previously described with respect to FIG. 2D.

Figure 6:
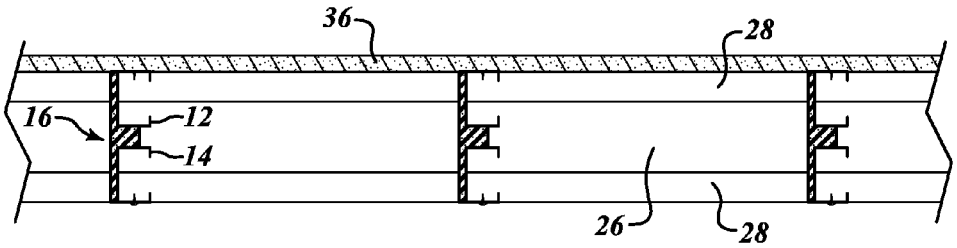
FIG. 6 is a cross-sectional view taken along the line 6-6, as shown in FIG. 5.

FIG. 6 is a cross-sectional view taken along the line 6-6, as shown in FIG. 5. In FIG. 6, the bottom acoustic dampening layer 26 can be seen, as well as the individual acoustic dampening members 16 which couple studs 12, 14 to each other in a final assembled wall. In addition, FIG. 6 also shows the more fully-assembled wall having drywall 36 placed thereon as would be present in the final construction of a fully completed wall. In particular, the drywall 36, as shown in FIG. 5, is present only on the back of the wall so that the interior construction of the wall can be more easily seen for purposes of illustration of the different structures of the embodiments as described herein. In FIGS. 5 and 6, the drywall 36 is also shown only on one side of the wall so that the final construction of the completed wall can be seen. As will be appreciated, in the final construction of a wall, the drywall 36 will be placed on both sides of the wall and then tape and appropriate mud will be applied after which the dry wall 36 may be painted or prepared as desired by the homeowner to complete construction of the wall.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A prefabricated assembly, comprising:

a first construction stud having a back wall and first and second sidewalls extending from respective first and second ends of the back wall generally parallel to each other and perpendicular to the back wall;

a second construction stud having a back wall and first and second sidewalls extending from respective first and second ends of the back wall generally parallel to each other and perpendicular to the back wall;

a first acoustic dampening member affixed to the first sidewall of the first construction stud, the second sidewall of the second construction stud, the back wall of the first construction stud and the back wall of the second construction stud to form a first joining member for a single, prefabricated unitary stud having the first and second construction studs affixed to each other with an acoustic dampening material connecting the first construction stud and the second construction studs to each other in the prefabricated assembly that has at least one side wall of each stud and the back wall of each stud affixed to the first acoustic dampening member, the first acoustic damping member including a first back member that is affixed to and extends generally parallel to the back wall of each of the first and second construction studs and a first isolation member that is continuous and unitary with the first back member and is positioned between and connected to respective sidewalls of the first and second construction studs;

a second acoustic dampening member spaced apart from the first acoustic damping member for a distance that is greater than length of the first acoustic damping member to result in an open space between the first and second studs and between the first and second acoustic dampening members, the open space extending for a length of the studs, the second acoustic dampening member being affixed to the first sidewall of the first construction stud, the second sidewall of the second construction stud, the back wall of the first construction stud and the back wall of the second construction stud, the second acoustic dampening member including a second back member that is affixed to and extends generally parallel to the back wall of each of the first and second construction studs and a second acoustic isolation member that is continuous and unitary with the first back member and extends between and is affixed to respective sidewalls of the first and second construction studs in the prefabricated assembly.

2. The assembly according to claim 1, further comprising:

a first unitary stud composed of the first construction stud and the second construction stud affixed to each other with the first acoustic dampening material;

a second unitary stud composed of a third construction stud and a fourth construction stud affixed to each other with a second acoustic dampening material, the first unitary stud being spaced from the second unitary stud;

a wall construction material affixed to the first unitary stud and the second unitary stud.

3. The assembly according to claim 2, further comprising:

a floor assembly attached to a floor;

a ceiling assembly attached to a ceiling; and each of the first and second unitary studs having a first end and a second end, opposite the first end;

the first ends of each of the first and second unitary studs attached to the floor assembly and the second ends of each of the first and second unitary studs attached to the ceiling assembly.

4. The assembly according to claim 2 wherein the wall construction material is drywall and the drywall extends from a floor region to a ceiling region.

5. The assembly according to claim 1, wherein each of the first and second construction studs are sheet metal studs that have a form of a channel formed by the backwall and first and second sidewalls of each of the respective first and second construction studs.

6. The assembly according to claim 1, wherein:

each of the first and second construction studs have a first end and a second end, opposite the first end;

the first acoustic dampening member is attached at the first end of the first and second construction studs; and a second acoustic dampening member is affixed to the first construction stud and the second construction stud at the second end of the first and second construction studs.

7. The assembly according to claim 1, wherein:

the first acoustic dampening member is steel.

8. The assembly according to claim 6, wherein:

the first acoustic dampening member is affixed to the first and second construction studs with screws.

9. The assembly according to claim 1, wherein:

the first acoustic dampening member is polymer foam material.

10. The assembly according to claim 9, wherein:

the first acoustic dampening member is affixed to the first and second construction studs with adhesive material.

11. A method of assembling a wall, comprising:

aligning a first construction stud and a second construction stud parallel to and spaced apart from each other, the first and second construction studs each having a back wall and first and second sidewalls extending from respective first and second ends of the back wall generally parallel to each other and perpendicular to the back wall;

affixing a first acoustic dampening member to the first sidewall of the first construction stud, the second sidewall of the second construction stud, the back wall of the first construction stud and the back wall of the second construction stud to form a single unitary stud having two construction studs affixed to each other with a first acoustic dampening material connecting the first construction stud and the second construction stud to each other, the first acoustic dampening member including a first back member that is connected to and extends generally parallel to the back wall of each of the first and second construction studs and a first isolation member that is continuous and unitary with the first back member and extends between and is connected to respective sidewalls of the first and second construction studs;

affixing a second acoustic dampening member to the first sidewall of the first construction stud, the second sidewall of the second construction stud, the back wall of the first construction stud and the back wall of the second construction stud to form a single unitary stud having two construction studs affixed to each other with a second acoustic dampening material that is spaced a distance away from the first acoustic damping member for a distance greater than the length of the first acoustic dampening member to provide an open space between the two acoustic dampening members that extends for a length of the unitary stud, the second acoustic dampening member including a second back member that is connected to and extends generally parallel to the back wall of each of the first and second construction studs and a second isolation member that is continuous and unitary with the first back member and extends between and is connected to respective sidewalls of the first and second construction studs;

transporting a plurality of unitary studs from an assembly facility to a construction site;

spacing a first unitary stud apart from a second unitary stud; and affixing a wall construction material to the first and second unitary studs.

12. The method of assembling a wall of claim 11, further comprising:

positioning a first acoustic dampening layer on a floor at a location for constructing a wall;

placing a first angled metal member on top of the first acoustic dampening layer;

positioning a second acoustic dampening layer on a ceiling at the location for constructing a wall and above the first acoustic dampening layer; and placing a second angled metal member on top of the second acoustic dampening layer.

13. The method of assembling a wall of claim 12, further comprising:

affixing a first end of the first unitary stud to the first angled metal member;

affixing a second end of the first unitary stud to the second angled metal member, the second end of the first unitary stud being opposite the first end of the first unitary stud.

14. The method of assembling a wall of claim 11, wherein affixing the wall construction material to the first and second unitary studs includes affixing wall board to the first and second unitary studs.

15. The method of assembling a wall of claim 11, further comprising: cutting the first and second construction studs to a predetermined length.

16. The method of assembling a wall of claim 11, wherein affixing the acoustic dampening member to the first construction stud and the second construction stud includes affixing the acoustic dampening member to the first construction stud and the second construction stud using adhesive.

17. The method of assembling a wall of claim 11, wherein affixing the acoustic dampening member to the first construction stud and the second construction stud includes screwing the acoustic dampening member to the first and second construction studs using screws.

18. An assembly, comprising:

a first sheet metal stud including a back wall and first and second sidewalls extending from the back wall, the back wall and first and second sidewalls defining a channel that is open at a side opposite the back wall;

a second sheet metal stud including a back wall and first and second sidewalls extending from the back wall, the back wall and first and second sidewalls defining a channel that is open at a side opposite the back wall;

a first acoustic dampening member affixed to and extending across a portion of the back walls of the first and second sheet metal studs and extending in between the first and second sheet metal studs as a continuous and unitary member; and a second acoustic dampening member spaced apart from the first acoustic damping member for a distance that is greater than length of the first acoustic damping member to result in an open space between the first and second studs and between the first and second acoustic dampening members, the open space extending for a length of the studs, the second acoustic dampening member being affixed to and extending across a portion of the back walls of the first and second sheet metal studs and extending in between the first and second sheet metal studs as a continuous and unitary member.

19. The assembly according to claim 18, wherein:

each of the first and second sheet metal studs have a first end and a second end, opposite the first end;

the first acoustic dampening member is attached at the first end of the first and second construction studs; and a second acoustic dampening member is affixed to the first construction stud and the second construction stud at the second end of the first and second construction studs.

20. The assembly according to claim 18, wherein:

the first acoustic dampening member is polymer foam material.

* * * * *